United States Patent [19]

Edson

[11] Patent Number: 4,683,459

[45] Date of Patent: Jul. 28, 1987

[54] ALARM SYSTEM TEST ANNUNCIATOR

[75] Inventor: James B. Edson, Concord, Mass.

[73] Assignee: ADT, Inc., Parsippany, N.J.

[21] Appl. No.: 738,576

[22] Filed: May 28, 1985

[51] Int. Cl.[4] ..... G08B 29/00; G08B 1/08

[52] U.S. Cl. ..... 340/514; 340/531; 340/539; 455/134; 455/159; 455/228; 381/51

[58] Field of Search ..... 340/514, 539, 531; 455/134, 159, 228, 229; 381/51–53

[56] References Cited

U.S. PATENT DOCUMENTS 4,455,551 6/1984 Lemelson ..... 340/539

4,531,235 7/1985 Brusen ..... 455/134

4,539,710 9/1985 Dinsmore ..... 455/134

*Primary Examiner*—Donnie L. Crosland

*Attorney, Agent, or Firm*—Weingarten, Schurgin, Gagnebin & Hayes

[57] ABSTRACT

Test apparatus for a wireless system is provided in which an audible annunciation is produced which is an accurate indication of the measured received signal strength. A signal is derived from the receiver which is representative of the signal strength and which is employed to activate a speech synthesizer which provides annuciation of each of a range of digits, each digit annunication representing a predetermined increment of received signal strength.

7 Claims, 3 Drawing Figures

ALARM SYSTEM TEST ANNUNCIATOR

FIELD OF THE INVENTION

This invention relates to alarm systems and more particularly to apparatus for testing wireless alarm systems.

BACKGROUND OF THE INVENTION

Alarm systems are known in which the sensors disposed at desired positions in a protected facility are in wireless communication with a central unit at the facility, each sensor location including a radio frequency (RF) transmitter which provides a coded transmission representing the status or alarm condition of the associated sensor. The transmission from each sensor is received and decoded by a receiver at the control unit to provide an output indication of status or alarm condition.

During installation of the sensor transmitters, and during testing of the sensor transmitters, it is important to measure the signal strength of the RF signal as received at the control unit. The control unit is usually remote from the sensor locations, and visual indications of signal strength at the control unit cannot be seen by installation or test personnel at the transmitter locations. There have been proposals for providing an audible indication at the control unit or signal strength, but the proposed techniques have not provided the convenience and accuracy necessary for ascertaining transmission strength margin and actual performance of the various transmitters in the system. One known test arrangement is employed in the CS-200 alarm system of Aritech Coporation in which an audible tone is produced at a control panel in response to activation of any sensor of the system.

The tone indicates that a sensor has been activated, but no measure of signal strength nor the ability to estimate signal margin is provided.

An alarm system of Alarm Device Manufacturing Co. has a test system which measures received signal strength and retransmits a signal in the FM broadcast band which is compsoed of a sequence of up to three tones, which provides a rough indication of signal strength, and no actual measure of received signal strength. This technique requires extra equipment for retransmitting the signal in the FM broadcast band and an FM receiver for receiving the retransmitted signal, and also requires the selection of a clear channel in the FM band.

SUMMARY OF THE INVENTION

In accordance with the present invention, test apparatus is provided for a wireless alarm system in which an audible annunciation is produced which is an accurate indication of the measured received signal strength. A signal is derivled from the receiver which is representative of the signal strength and which is employed to activate a speech synthesizer which provides annuciation of each of a range of digits, each digit annuciation reprensenting a predetermined increment of received signal strength. Typically, for a 50db useful range of RF received signal strength, each digit annunciation represents a 5db increment.

DESCRIPTION OF THE DRAWINGS

The invention will be more fully understood from the following detailed description taken in conjunction with the accompanying drawings in which.

DETAILED DESCRIPTION OF THE INVENTION

Figure 1:
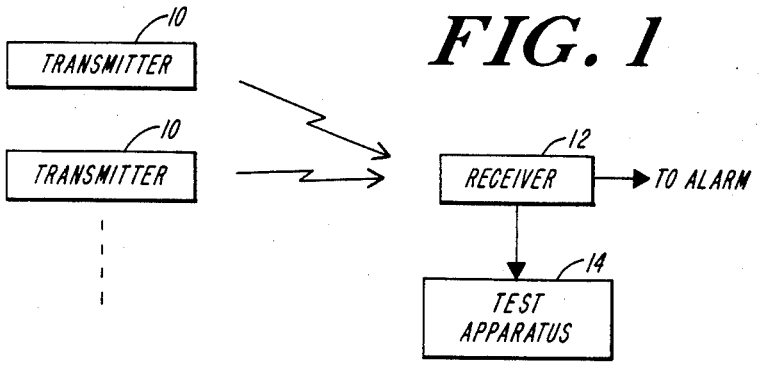
FIG. 1 is a block diagram of a wireless alarm system in which the invention is employed.
Figure 2:
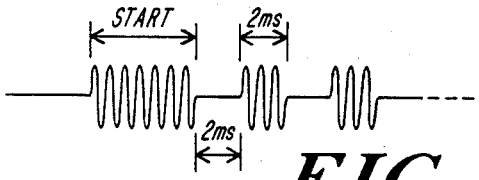
FIG. 2 is a signal diagram of the data format employed in the alarm system.

Referring to FIG. 1, there is shown a wireless alarm system in which the present invention is employed and which includes one or more RF transmitters 10 and a receiver 12 operative to receive signals transmitted by each of the transmitters. Each transmitter provides a coded representation of the system address, a coded representation of the identity of the particular transmitter within that system, and data representing an alarm indication or status. The receiver is operative to detect a valid system code and to provide an output indication of the identity of the transmitter whose signal is being received and the status information being transmitted. In the illustrated embodiment, data is encoded by tone bursts of 14 and 23 kilohertz. The data format is illustrated in FIG. 2 and comprises a sycn burst at 23 kilohertz and of a 12–14 millisecond length. This sync burst functions as a start code to signify the beginning of a data cycle. Each data bit is provided by a 2 millisecond tone of 14 kilohertz for one polarity bit and 23 kilohertz for the opposite polarity bit. A 2 millisecond gap is provided between data tones. Typically, a frame rate of 80–90 milliseconds is provided; that is, a transmission sequence is sent once during each frame interval of 80–90 milliseconds.

Figure 3:
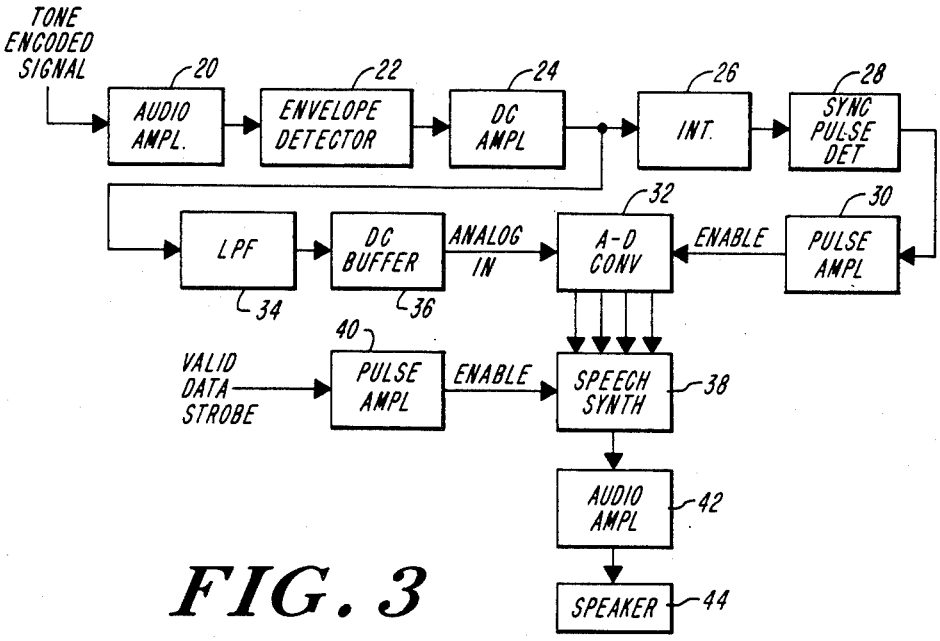
FIG. 3 is a block diagram of test apparatus embodying the invention.

The system functionality is tested by the test apparatus 14, and an output annunciation is provided indicative of the received signal strength. The test apparatus is shown in block diagram form in FIG. 3. the tone encoded signal at the output of the Rf detector of the receiver is applied to an audio amplifier 20 tuned to 23 kilohertz, and the output of which is applied to an envelope detector 22. The output of the envelope detector provides DC pulses which are amplified by Dc amplifier 24 and provided to an integrator 26 having a slow charge rate and a fast discharge rate. The integrator 26 is operative to detect the relatively long sync pulse provided at the beginning of each transmission cycle. The output of integrator 26 is applied to a sync pulse detector 28 which, upon detection of the sync pulse, provides an output pulse to a pulse amplifier 30, the output of which is provided as an enable pulse to an analog-to-digital converter 32. The DC pulses from DC amplifier 24 are also applied to a low pass filter 34, the output of which is applied via a DC buffer 36 to the analog input of the the A-D converter 32. The converter 32 provides a multiple bit digital output representative of the amplitude of the analog input signal provided by DC buffer 36. The digital output from the converter 32 is applied to the address input of a speech synthesizer 38 which is enabled by a signal derived from the receiver upon detection of a valid system address. The synthesizer is preferably in integrated circuit form such as a General Instrument W SR0 256. The valid data strobe from the receiver is applied via a pulse amplifier 40 to the enable input of the speech synthesizer 38. The synthesizer output provides audio speech signals which are applied via an audio amplifier 42 to a loudspeaker 44. The selective enabling of the speech synthesizer upon detection of a valid system address is useful even for a system in which a single transmitter is employed to provide discrimination against spurious signals which could be received. Such a strobe signal is not, however, necessary and in some implementations need not be employed.

The audio amplifier 20, envelope detector 22 and DC amplifier 24 have a gain characteristic to achieve an intended scaling of the input signal. For a superregenerative receiver, the amplitude of the receiver output signal is a logarithmic function of the received signal strength. Sor other types of receivers, the relationship between amplitude and signal strength may be different. In any event, the gain characteristic of the test system can be determined to suit the function or relationship for the particular receiver with which the test apparatus is employed.

In the illustrated embodiment, the speech synthesizer 38 is operative to provide annunciation of the digits 0–10. Each digit annunciation represents a 5 db increment of a 50 db useful range of RF received signal strength being measured. The verbal annunciations are in their informational content like the visual indications of an S meter, which is known for RF signal strength measurement. Thus, the verbal annunciation is provided in terms familiar to those who are familiar with S meter usage. Each annunciation digit provided by the speech synthesizer is associated with a range of digital inputs provided by the converter 32. Thus, for each range of digital outputs from the converter 32, a corresponding numeral is "spoken" by the synthesizer.

The test apparatus is typically housed on a circuit board which can be contained within a small loudspeaker case to provide a compact, readily portable test instrument. Input leads for the tester are connected to the RF detector output of the receiver.

Accurate and quantitative information is provided by the invention to permit proper alarm system installation and testing. The invention greatly enhances the effeciency of testing of an alarm system, since the test operator need not be positioned in sight of the system under test, such as is required to witness a visual indicator, and need not be within sight of a test unit which employs an S meter or other visual indicator for monitoring purposes.

The invention is not to be limited by what has been particularly shown and described except as indicated in the appended claims.

What is claimed is:

1. For use in a wireless alarm system having one or more transmitters each providing a coded transmitted signal representing status and alarm conditions, and a receiver for receiving each of the transmitted signals, test apparatus comprising:

first means operative in response to a signal from the receiver which is representative of signal strength to provide a first signal;

second means for providing a digital signal representative of the first signal;

speech synthesizer means;

means for providing the digital signal to the synthesizer means to cause the provision of an audio output signal representing a digit corresponding to the signal strength represented by the digital signal, said means for providing the digital signal being responsive to said coded transmitted signal; and output means operative in response to the audio output signal to provide verbal annunciation of the digit represented by the audio output signal.

2. The invention of claim 1 wherein the synthesizer means includes means for providing an enable signal to the synthesizer means upon detection of a valid address code in the transmitted signal.

3. The invention of claim 1 wherein the transmitted signal includes a start code and data codes;

and wherein the first means includes:

means for providing signal strength data to the second means; and means operative to enable the second means upon detection of the start code.

4. The invention of claim 3 wherein the second means includes an analog to digital converter providing a multiple bit output signal as an address input to the synthesizer means.

5. The invention of claim 4 wherein the transmitted signals are encoded by tone bursts of first and second frequency and including a sync burst of a duration longer than the duration of the data bursts.

6. The invention of claim 5 wherein the first means includes:

integrator means having a slow charge and a fast discharge rate and operative to detect the relatively long sync burst and to provide an output pulse representative thereof for enabling the converter means.

7. The invention of claim 6 wherein the output means includes an audio amplifier and loudspeaker for producing the verbal annunciation.

* * * * *